US006979106B2

(12) United States Patent
de Peralta

(10) Patent No.: US 6,979,106 B2
(45) Date of Patent: Dec. 27, 2005

(54) CONTROL SYSTEM FOR OPTICAL MEDIA IN A LUMINAIRE

(75) Inventor: Jeffrey de Peralta, Woodland Hills, CA (US)

(73) Assignee: Electronics Theatre Controls, Inc., Middleton, WI (US)

( * ) Notice: Subject to any disclaimer, the term of this patent is extended or adjusted under 35 U.S.C. 154(b) by 103 days.

(21) Appl. No.: 10/655,954

(22) Filed: Sep. 5, 2003

(65) Prior Publication Data

US 2005/0052872 A1 Mar. 10, 2005

(51) Int. Cl.[7] ..... F21V 17/02

(52) U.S. Cl. ..... 362/321; 362/320; 362/268; 362/352; 362/282

(58) Field of Search ..... 362/268, 321, 362/320, 352, 282, 283, 284

(56) References Cited

U.S. PATENT DOCUMENTS 3,555,264 A * 1/1971 Schimmelpfennig ..... 362/284
4,777,566 A * 10/1988 Lowell et al. ..... 362/3
5,073,847 A * 12/1991 Bornhorst ..... 362/293
5,347,432 A * 9/1994 Chiavetta ..... 362/18
5,432,683 A * 7/1995 Brown ..... 362/16

* cited by examiner

*Primary Examiner*—Stephen Husar
*Assistant Examiner*—Anabel Ton
(74) *Attorney, Agent, or Firm*—Greer, Burns & Crain, Ltd.; Philip M. Kolehmainen

(57) ABSTRACT

A zoom lens system includes a motor driven lens assembly that is movable on a track in a normal movement range for adjusting the light beam range angle of a luminaire. A pair or doors are pivoted to opposite sides of the frame of the lens assembly and are normally biased to an inactive position where the doors are parallel to and outside of the light path in the luminaire. The doors hold optical media such as diffuser gels. The lens assembly can be moved beyond the normal movement range to an actuation position where projections on the doors engage actuation abutments adjacent the track to move the doors to an active position overlying the lens with the optical media in the light path. A latch holds the door in the active position. The lens assembly can be moved beyond the actuation position to a deactivation position where a deactivation abutment releases the latch freeing the doors to return to the inactive positions.

15 Claims, 5 Drawing Sheets

CONTROL SYSTEM FOR OPTICAL MEDIA IN A LUMINAIRE

FIELD OF THE INVENTION

The present invention relates to an improved system for controlling the position of an optical medium, such as a diffuser gel, in a luminaire.

DESCRIPTION OF THE PRIOR ART

Luminaires for theatrical applications such as stage and studio lighting typically include a housing with a light source providing a beam of light that travels along a light path from the light source to an exit opening in the housing. A projection optics system may be used to control the projected beam of light. Known theatrical luminaires can have a zoom lens assembly for varying the light beam field angle. In an automated, remotely controllable zoom lens system, one or more lenses are moved by one or more drive motors forward and back in the direction of the light path axis.

In many circumstances it is desirable to place an optical medium in the light path within the luminaire in order to create an optical effect. Optical media used for this purpose include colored gels, diffusers such as diffuser gels, glass media such as dichroic elements and apertured baffles such as beam shaping annular baffles known as donuts.

For example, a luminaire that normally serves as a spot, projecting a focused, coherent beam of light, can be transformed into a wash, projecting a diffused, soft light beam. This transformation is done by placing a diffuser into the light path. In known luminaires, a diffuser gel in a frame or support can be manually inserted into or attached to a luminaire to provide a wash effect, and the diffuser can be removed to provide a spot effect. In other approaches, to avoid the need for inconvenient manual operations, a wheel or scroll containing a variety of optical media such as colored gels, diffusers and others can be motor driven and remotely operated to place a diffuser or other selected medium in the light path.

Known arrangements for controlling the presence and absence of a diffuser or other optical medium in the light path of a luminaire are subject to disadvantages. Manual systems are inconvenient and are not capable of automation. Power operated systems used in the past have been complex and expensive. In particular, known systems that use a dedicated motor to move a diffuser or similar medium are expensive, complex and add substantial undesirable weight to the luminaire. There is an unfilled need for a control system for optical media in a luminaire that is reliable yet inexpensive and simple.

SUMMARY OF THE INVENTION

A primary object of the present invention is to provide an improved control system for optical media in a luminaire. Other objects are to provide a control system that is simple and inexpensive, that is capable of being remotely controlled and automated, that does not require a dedicated drive motor, and that overcomes disadvantages of known luminaire diffuser systems.

In brief, in accordance with the invention there is provided a control system for optics in a luminaire having a light path. The control system includes a luminaire housing and a track extending along the light path in the housing. A lens assembly includes a lens frame mounted for movement along the track and also includes a lens in the light path. A drive system includes a drive motor for moving the lens frame. A pair of doors are pivotally mounted at opposite sides of the lens frame for movement between an inactive position generally parallel to the light path and an active position wherein the doors overlie the lens in the light path. A pair of actuation abutments are located adjacent the track. Each of the doors includes a projection engageable with one of the actuation abutments in response to movement of the lens frame toward the actuation abutments. The actuation abutments and the projections are constructed and arranged to move the doors from the inactive positions to the active positions in response to engagement of the projections with the actuation abutments.

BRIEF DESCRIPTION OF THE DRAWING

The present invention together with the above and other objects and advantages may best be understood from the following detailed description of the preferred embodiment of the invention illustrated in the drawings, wherein.

DESCRIPTION OF THE PREFERRED EMBODIMENT

Figure 1:
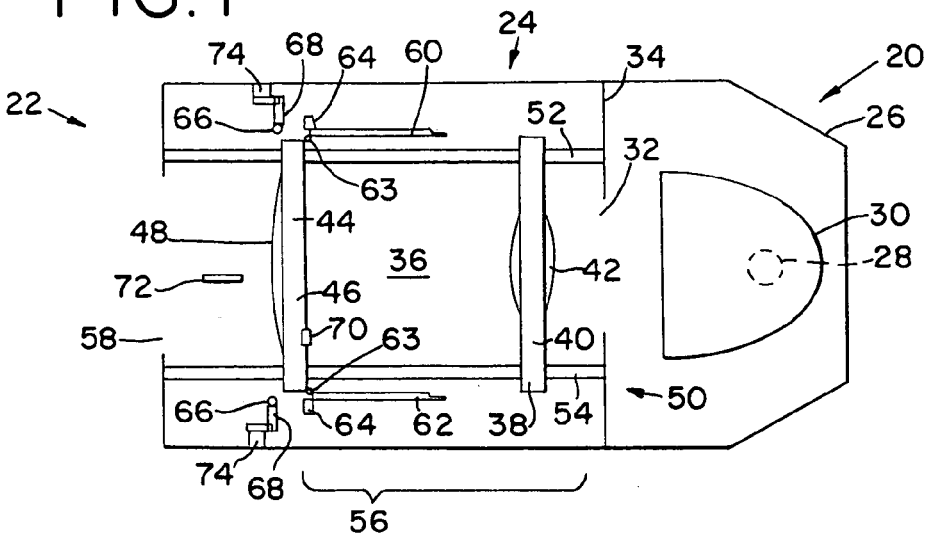
FIG. 1 is a simplified diagram showing a luminaire having an optical media control system constructed in accordance with the present invention, with doors holding optical media in the inactive position.

Having reference to the drawings, and initially to FIGS. 1–6, these are highly simplified diagrams of a luminaire 20 provided with a media control system generally designated as 22 and constructed in accordance with the principles of the present invention. The luminaire 20 includes a zoom lens system 24. In accordance with the present invention, the control system 22 is operated by the lens system 24 and as a result is simple, light in weight, and does not require its own motor or other power system.

The luminaire 20 includes a housing 26 containing a light source in the form of a bulb 28 and reflector 30 that emit a beam of light through an aperture 32 in a baffle 34 and along a light path 36. The lens system 24 includes a rear lens assembly 38 having a frame 40 and lens 42 and a forward lens assembly 44 having a frame 46 and lens 48. The forward and rear lens assemblies 44 and 38 are movable along a track 50 having a spaced pair of guide rods 52 and 54 extending axially alongside the light path 36. Motors and drive systems described below in connection with FIGS. 7–10 move the forward and rear lens assemblies 44 and 38 through a range of normal movement indicated by bracket 56 in FIG. 1 in order to vary the range angle of the light beam projected through a light exit opening 58 in the housing 26.

The media control system 22 includes a pair of doors 60 and 62 pivotally connected to the forward lens frame 46 by hinges 63. As appears below, each door 60 and 62 carries an optical medium. In the illustrated preferred embodiment of the invention, the medium is a diffuser gel, but the doors 60 and 62 could carry other types of optical media. The doors 60 and 62 can be rotated to an inactive position seen in FIGS. 1, 5 and 6 in which the doors 60 and 62 are generally parallel to, and out of the light path 36. In this position, the luminaire 20 operates as a spot, projecting a focused, coherent beam of light.

Figure 3:
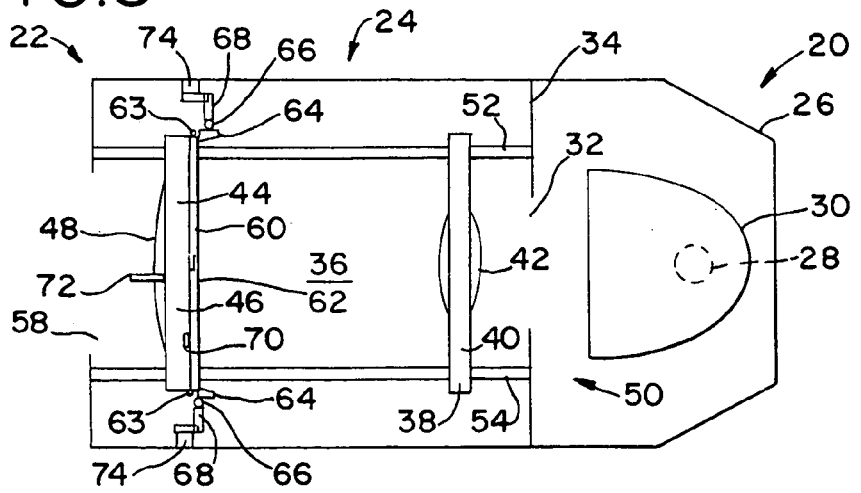
FIG. 3 is a view like FIGS. 1 and 2 showing the system with the doors in the active position.
Figure 4:
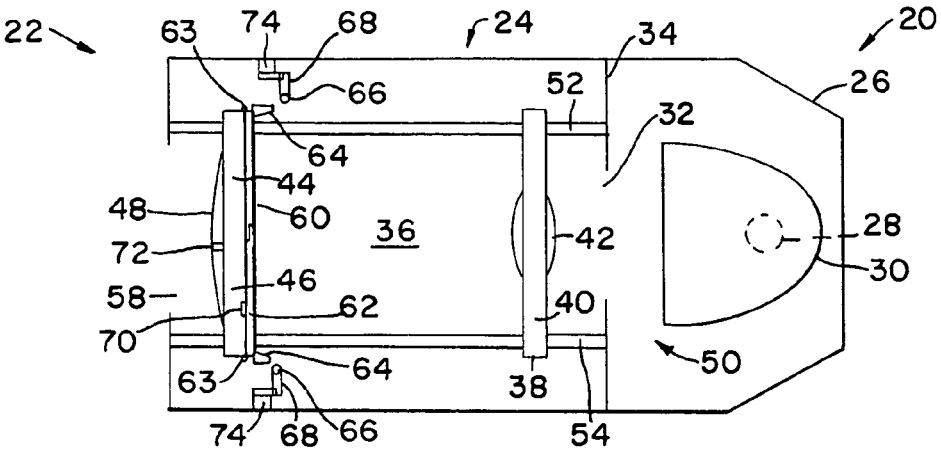
FIG. 4 is a view like FIGS. 1–3 showing the system with the doors approaching the deactivation stop.
Figure 5:
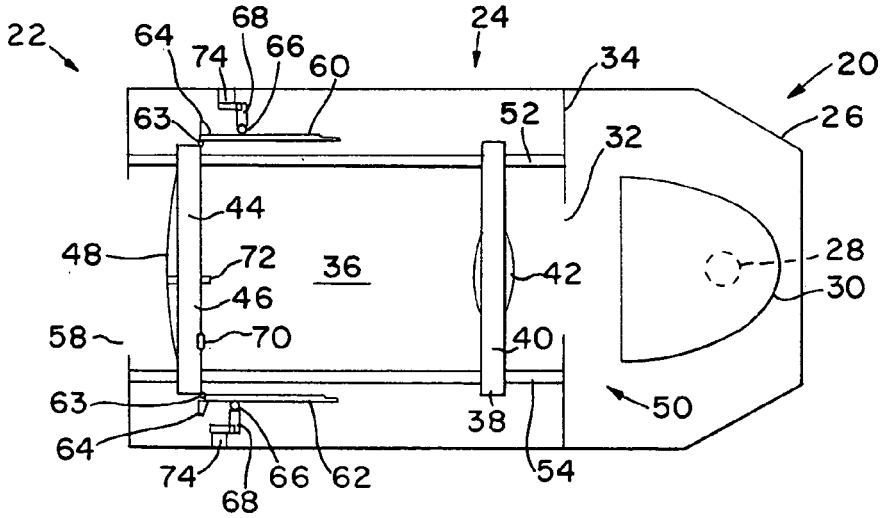
FIG. 5 is a view like FIGS. 1–4 showing the system with the doors returned to the inactive position.

As seen in FIGS. 3 and 4, the doors 60 and 62 can be rotated to an active position in which the doors 60 and 62 and the media carried by the doors intersect the entire light path 36. When the optical medium is a diffuser, the light beam is diffused by the diffuser, and with the doors 60 and 62 in the active position, the luminaire 20 operates as a wash fixture, projecting a soft, diffuse beam of light.

Figure 2:
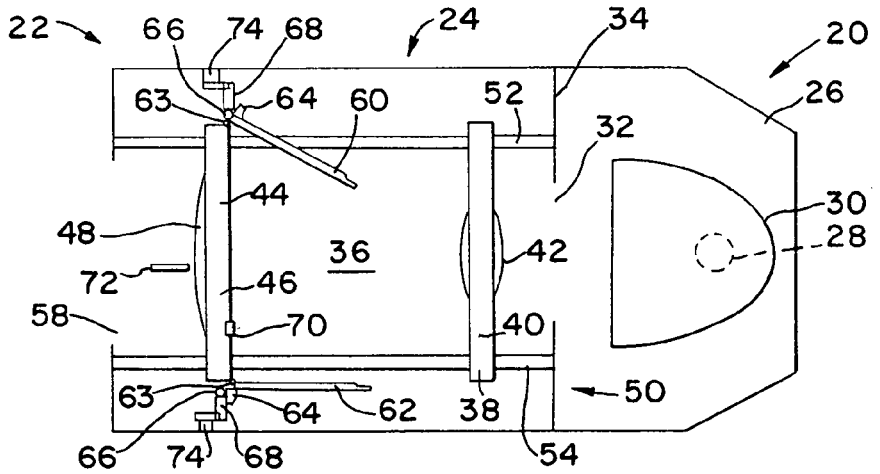
FIG. 2 is a view like FIG. 1 showing the system with the doors being moved toward the active position by contact with the actuation pawls.

The doors 60 and 62 are moved between the active and inactive positions in response to movement of the front lens assembly 44 forward beyond the normal focusing range of movement 56. The doors 60 and 62 include projecting actuating lever portions 64. As the frame 46 moves forward beyond the normal range 56, the lever portions 64 engage rollers 66 carried by actuation pawls 68. As seen in FIG. 2, the engagement of the forward moving levers 64 with the pawl rollers 66 rotates the doors 60 and 62 from the inactive to the active positions.

The pawls 68 are slightly offset in the axial direction so that the door 60 reaches the active position, generally perpendicular to the light path axis, before the door 62. This staggered or timed movement is seen in FIG. 2 where door 60 is moving ahead of door 62. When the doors 60 and 62 reach their active positions, the free edge of door 62 overlies the free edge of door 60 as seen in FIG. 3.

A latch 70 holds the door 62 in the active position. Door 62 holds the door 60 in the active position. Preferably the latch 70 is a magnet that is contacted by a magnetic metal portion of the door 72.

After the doors 60 and 62 are moved to and are latched into the active position, the front lens assembly 44 is returned rearwardly to any elected position in the range 56 of normal movement. Both lens assemblies 38 and 44 can operate normally with the diffuser doors 60 and 62 latched in the active positions.

To return the doors 60 and 62 to their inactive positions, the forward lens assembly 44 is again moved forward beyond the normal motion range 56. As seen in FIG. 4, the forward lens frame 46 moves forward beyond the pawl actuating position seen in FIG. 3. In the fully forward position of FIG. 4, the door 62 strikes a deactivation stop 72. The stop 72 causes the forward moving door 62 to move away from the latch magnet 70. When the door 62 moves free of the magnet latch 70, a door biasing spring returns the door 62 to its inactive position. When the the door 60 is released from the door 62 a door biasing spring returns the door 60 to its inactive position.

Figure 6:
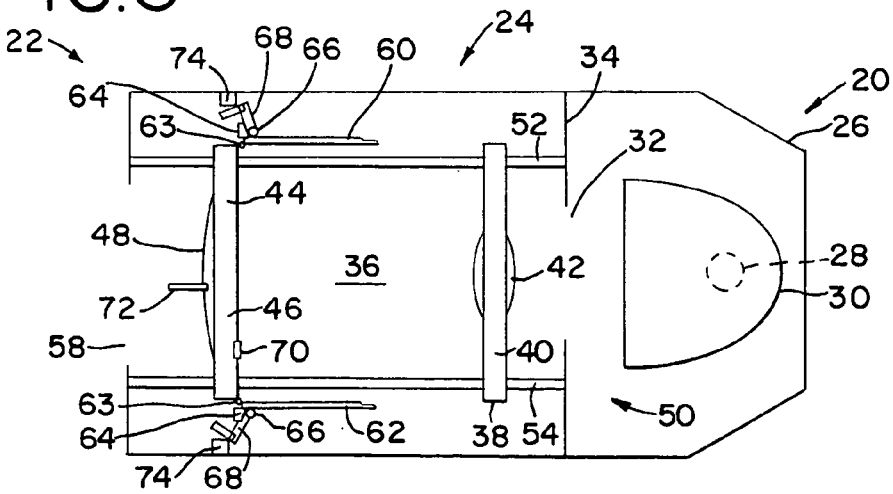
FIG. 6 is a view like FIGS. 1–5 showing the system with the doors deflecting the activation pawls.

With the doors 60 and 62 in the inactive positions, the forward lens assembly 44 is returned to the normal movement range 56. The pawls 68 are normally held by pawl springs described below against pawl stops 74. As the lens frame 46 moves rearward past the pawls 68, the lever portions 64 engage the pawl rollers 66 and rotate the pawls away from the stops 72 as seen in FIG. 6. This retraction of the pawls 68 permits the doors 60 and 62 in the inactive position to move rearward past the pawls 68. When the forward lens assembly 44 returns to the normal range of motion, both lens assemblies 38 and 44 can operate normally with the diffuser doors 60 and 62 in the inactive positions.

Details of the luminaire 20, diffuser control system 22 and zoom lens system are seen in FIGS. 7–11 where the same reference characters are used for elements common to FIGS. 1–6.

Figure 7:
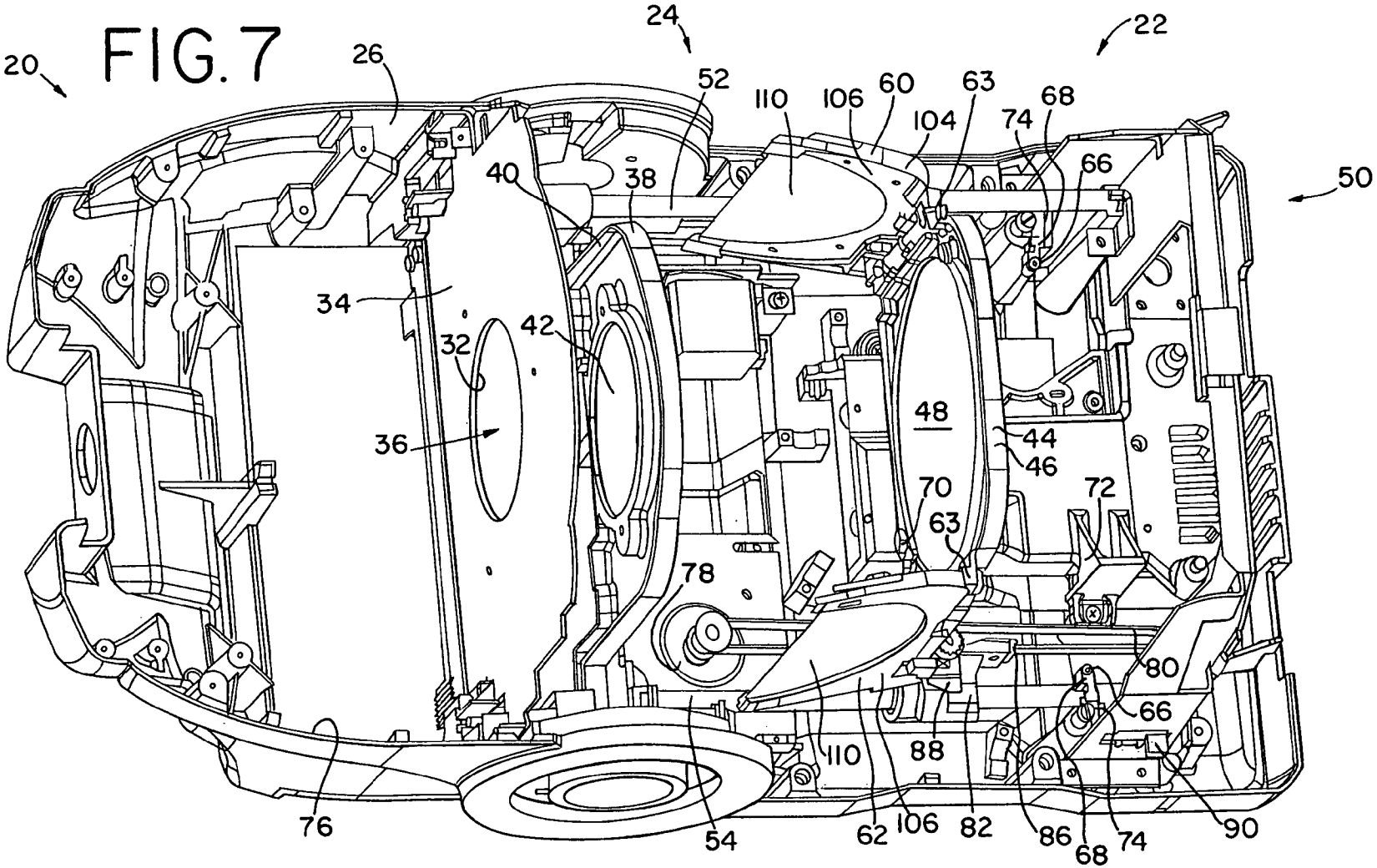
FIG. 7 is a rear, top and side isometric view of a luminaire having an optical media control system constructed in accordance with the present invention.

FIG. 7 illustrates the luminaire 20 with the cover for housing 26 removed to expose the interior components. The light source is also removed from a light section 76 of the housing 26. Reference may be had to copending U.S. patent application Ser. No. 10/294,209 filed on Nov. 14, 2002, incorporated herein by reference, for a description of the light source beyond that helpful to an understanding of the present invention.

The illustrated base of housing 26 is a metal part incorporating the pawl stops 74 and the activation stop 72, and supporting and positioning the components of the media control system 22 and the zoom lens system 24. The housing 26 supports the guide rods 52 and 54 parallel to one another and extending parallel to and below the light path 36. The forward lens assembly 44 is moved forward and back along the drive rods 52 and 54 by a drive motor 78 and drive belt 80.

Figure 8:
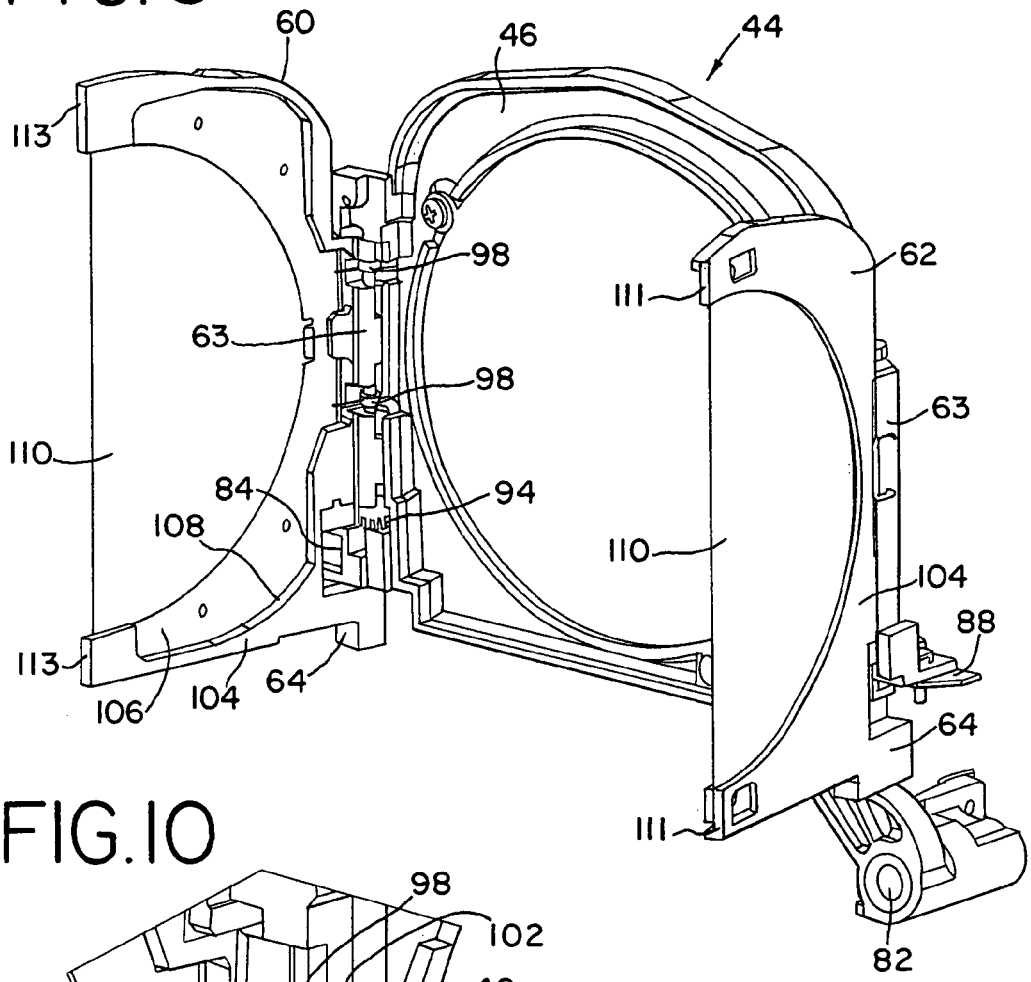
FIG. 8 is rear isometric view of the front lens and door assembly.
Figure 9:
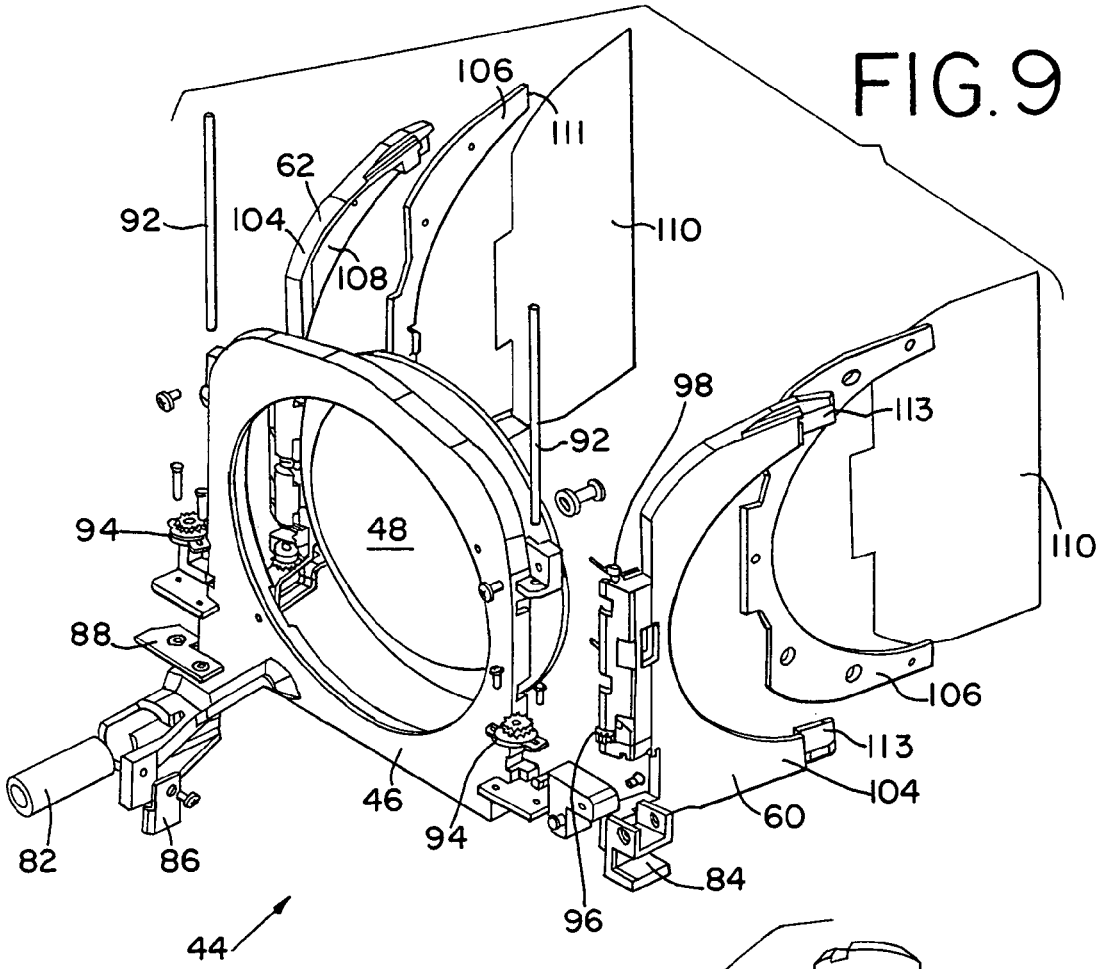
FIG. 9 is an exploded front isometric view of the front lens and door assembly.

The forward lens assembly 44 is illustrated in FIGS. 8 and 9. It includes a guide bearing 82 that slides along the guide rod 54, and a float bushing 84 that receives and slides along the other guide rod 52. The float bushing 84 is open sided to permit free motion of the lens assembly 44 even if the guide rods 52 and 54 are inadvertently misaligned. A belt clamp 86 fastens the lens frame 46 to the drive belt 80 so that rotation of the drive motor results in sliding movement of the forward lens assembly 44 along the track 50. A sensor flag 88 cooperates with a sensor 90 in the housing 26 (FIG. 7) to provide position feedback to a control system for the luminaire 20.

Figure 10:
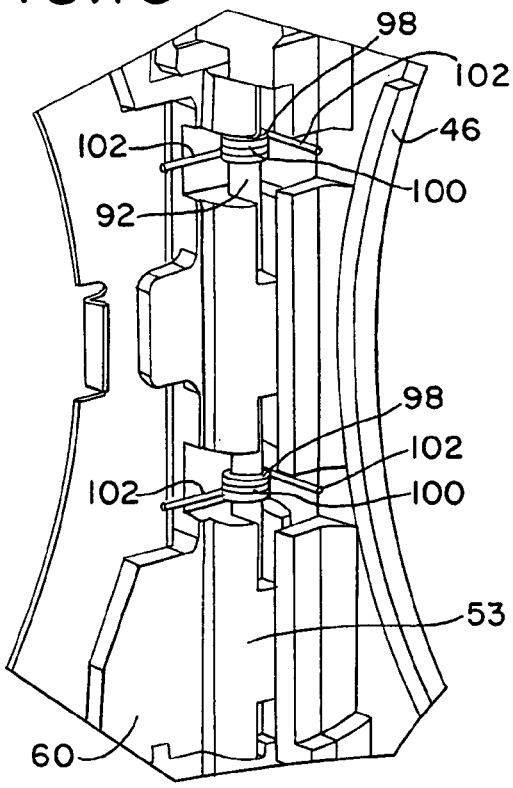
FIG. 10 is an enlarged, fragmentary isometric view showing portions of a door and the lens frame with part of the hinge and door spring.

The hinges 53 include hinge pins 92 for pivotal mounting of the doors 60 and 62 at the opposite sides of the lens frame 46. A pair of rotary dampers 94 mounted to the frame 44 have gears meshing with gear teeth 96 formed on the doors 60 and 62 so that the doors 60 and 62 move slowly and quietly from the active positions to the inactive positions. The doors 60 and 62 are normally held in their inactive positions by door springs 98 (FIG. 10). Each door spring 98 includes a spring coil 100 around the corresponding hinge pin 92, and free ends 102 bearing against the lens frame 44 and door 60 or 62.

Each door 60 and 62 includes a door frame 104 and a magnetic metal media holder 106 that is fastened into a recess 108 in the door frame 104. An optical medium 110 is clamped into each media holder 106 before the media holder 106 is fastened in place. The user can use the media holder 106 as a template to prepare any desired optical medium for use in the media control system. The latch magnet 70 contacts the metal media holder 106 and holds the door 62 in the active position of the door 62. The ends 111 of the frame 104 of door 62 overlie the ends 113 of the frame 104 of door 60 to hold the door in the active position. The edges of the optical media 110 are inset slightly from the frame ends 111 and 113 so that the edges of the optical media are aligned but not overlapping in the active positions of the doors 60 and 62.

Figure 11:
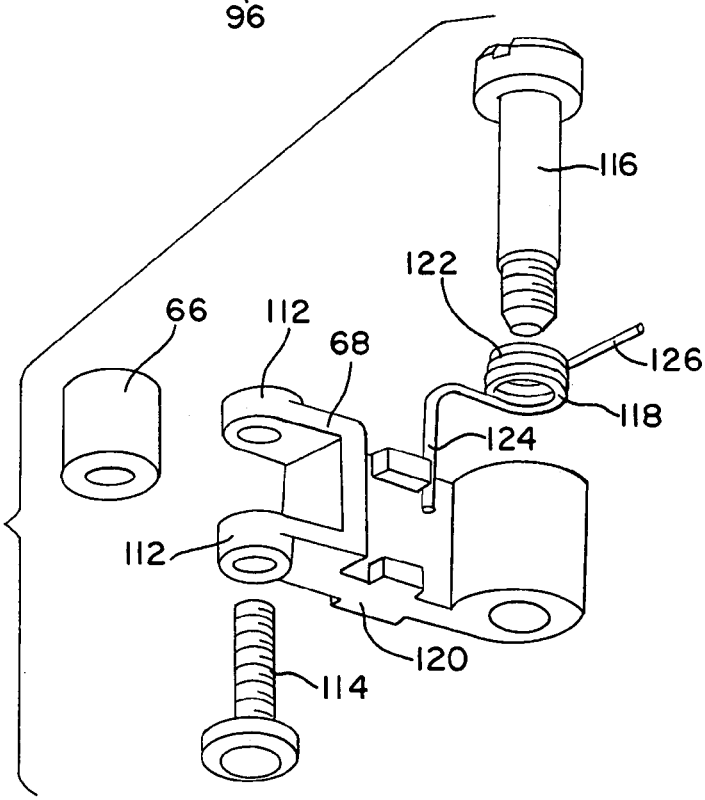
FIG. 11 is an exploded isometric view of components of an actuation pawl assembly.

As seen in FIG. 11, each of the two actuation pawls 68 includes a pair of arms 112 cooperating with a fastener 114 for holding the pawl roller 66. The pawl 68 is mounted to the housing 26 with another fastener 116. A pawl spring 118 continuously biases the pawl 68 toward its normal position wherein a stop abutment 120 on the pawl engages the corresponding pawl stop 74. The pawl spring 118 includes a spring coil 122 surrounding the fastener 116, a first end 124 engaging the pawl 68 and a second end 126 engaging a fixed reaction surface on the housing 26.

While the present invention has been described with reference to the details of the embodiment of the invention shown in the drawing, these details are not intended to limit the scope of the invention as claimed in the appended claims.

What is claimed is:

1. A control system for optics in a luminaire having a light path, said control system comprising:

a luminaire housing:

a track extending along the light path in said housing;

a lens assembly including a lens frame mounted for movement along said track and including a lens in the light path;

a drive system including a drive motor for moving said lens frame;

a pair of doors pivotally mounted at opposite sides of said lens frame for movement between an inactive position generally parallel to said light path and an active position wherein said doors overlie said lens in the light path; and a pair of actuation abutments adjacent said track;

each of said doors including a projection engageable with one of said actuation abutments in response to movement of said lens frame toward said actuation abutments;

said actuation abutments and said projections being constructed and arranged to move said doors from the inactive positions to the active positions in response to engagement of said projections with said actuation abutments.

2. A control system as claimed in claim 1, further comprising a door latch on said lens frame retaining said doors in the active position.

3. A control system as claimed in claim 2, said latch comprising a magnet.

4. A control system as claimed in claim 2, said track including a normal movement range for said lens assembly and said actuation abutments being located in an actuation position beyond said normal movement range.

5. A control system as claimed in claim 4, further comprising a deactivation abutment located adjacent said track in a deactivation position, said actuation position being located between said deactivation position and said normal movement range, said deactivation abutment being in the path of said doors for releasing said latch in response to movement of said doors into said deactivation position.

6. A control system as claimed in claim 5, said actuation abutments being retractable to permit movement of said doors from said deactivation position to said normal movement range.

7. A control system as claimed in claim 6, said actuation abutments comprising pivotally mounted pawls.

8. A control system as claimed in claim 2, further comprising a deactivation abutment adjacent said track in the path of movement of said doors for releasing said latch in response to contact of said doors with said deactivation abutment.

9. A control system as claimed in claim 1, further comprising optical media held by said doors.

10. A control system as claimed in claim 9, said optical media comprising gels.

11. A control system as claimed in claim 10, said gels comprising diffusers.

12. An apparatus for controlling an optical medium in a luminaire having a light path for a beam of light, said apparatus comprising:

a track in the luminaire extending along the light path;

a support mounted for movement along the track;

a motor for moving the support along the track;

a door pivotally mounted on said support for movement between an inactive position and an active position intersecting the light path;

said door including a carrier for the optical medium;

said door including an abutment surface; and an actuator mounted adjacent said track in the path of said abutment surface for pivoting said door in response to contact between said abutment sand said actuator.

13. The apparatus of claim 12, said support comprising a lens frame for a lens.

14. The apparatus of claim 12, said door being pivotally mounted at one side of support, a second door pivotally mounted at an opposed side of said support.

15. A diffuser control system for a luminaire having a light path with a longitudinal axis, said diffuser control system comprising:

a lens frame positioned generally perpendicular to the light path axis;

a lens held by said frame in the light path;

a door including a diffuser medium;

said door being mounted to said lens frame for pivotal movement between an inactive position out of said light path and an active position wherein said diffuser medium intersects said light path;

an abutment;

an elongated support extending in the axial direction along the light path;

said lens frame being mounted on said support for movement of said lens frame and door in the axial direction along said support;

an abutment in the path of movement of said door;

said door including an actuating lever portion contacting said abutment for moving said door between said inactive and active positions.

* * * * *